United States Patent [19]

Sasaki et al.

[11] Patent Number: 4,521,483

[45] Date of Patent: Jun. 4, 1985

[54] VINYLIDENE FLUORIDE RESIN FILAMENT AND PRODUCTION THEREOF

[75] Inventors: Tohru Sasaki; Hiroyuki Endoh, both of Iwaki; Seiichi Ohira, Kita-Ibaraki, all of Japan

[73] Assignee: Kureha Kagaku Kogyo Kabushiki Kaisha, Tokyo, Japan

[21] Appl. No.: 573,684

[22] Filed: Jan. 25, 1984

[30] Foreign Application Priority Data

Feb. 2, 1983 [JP] Japan ..... 58-15783

[51] Int. Cl.[3] ..... D02G 3/00; B32B 23/00; B29F 3/10

[52] U.S. Cl. ..... 428/373; 428/375; 428/392; 428/421; 264/171

[58] Field of Search ..... 428/373, 421, 422, 375, 428/392; 264/171, 210.7

[56] References Cited

U.S. PATENT DOCUMENTS

| | | | |
|---|---|---|---|
| 4,302,556 | 12/1981 | Endo et al. | 264/210.7 |
| 4,339,499 | 7/1982 | Tappe et al. | 428/323 |
| 4,353,960 | 10/1982 | Endo et al. | 428/373 |
| 4,382,358 | 5/1983 | Tappe et al. | 428/394 |
| 4,386,132 | 5/1983 | Dille et al. | 428/394 |

*Primary Examiner*—George F. Lesmes
*Assistant Examiner*—Beverly K. Johnson
*Attorney, Agent, or Firm*—Wenderoth, Lind & Ponack

[57] ABSTRACT

A composite fiber comprises at least a two layer structure of a sheath and a core, each layer comprising a vinylidene fluoride resin, the core portion having an inherent viscosity of 1.10 dl/g and the sheath portion having an apparent viscosity lower than that of the core portion, said composite fiber having a birefringence of at least $36.0\times10^{-3}$. This composite fiber, which has excellent knot strength (as high as 91 kg/mm$^2$), high tensile strength (as high as 103 kg/mm$^2$), excellent luster, and high processability and productivity, is produced by preparing a composite comprising a core portion of a vinylidene fluoride resin having an inherent viscosity of at least 1.10 dl/g and at least one layer of a sheath portion covering over said core portion, which has an apparent viscosity lower than that of the vinylidene fluoride resin of the core, while at least one of the core portion and the sheath portion is in molten state, and then subjecting the composite to at least one-step stretching to a stretching degree of 5.0-fold or more at a temperature which is lower by 5° C. or more but not lower by 30° C. or more than the melting point of the resin of the core.

16 Claims, No Drawings

VINYLIDENE FLUORIDE RESIN FILAMENT AND PRODUCTION THEREOF

BACKGROUND OF THE INVENTION

This invention relates to a vinylidene fluoride resin filament having high knot strength and a process for producing the same.

Vinylidene fluoride resin filaments have almost ideal characteristics as filaments for fishery uses, but their monofilaments are readily broken at knots, and therefore further improvement in knot strength has been desired. The knot strength increases with decrease in the filament diameter, but smaller diameters will result in, as a matter of course, lowering of tensile strength and knot tenacity which is defined by "(knot strength)×(cross-section area of the filament)". Increasing of orientation up to a certain degree of orientation will also improve the knot strength, but an orientation exceeding such a degree contrariwise lowers the knot strength. Improvement of knot strength is also expected theoretically by increasing the degree of polymerization, but an increase of the degree of polymerization will bring about lowering of processability, whereby realization of high knot strength has also been limited. Thus, obtention of high knot strength without impairing other practically important physical properties and processability has been limited.

SUMMARY OF THE INVENTION

An object of the present invention is to provide a vinylidene resin filament having high knot strength without impairment of other practically important physical properties and processability.

The present invention is based on a discovery that higher knot strength can be obtained by making the structure of a filament a double-layer or composite structure of a sheath and a core and making the viscosity of the sheath lower than that of the core, without bringing about lowering of the knot strength even when the orientation is further increased to a degree higher than that which has heretofore imparted the maximum knot strength to the filament.

More specifically, the composite fiber according to the present invention comprises a multiple structure of at least one sheath and a core, each layer comprising a vinylidene fluoride resin, the core portion having an inherent viscosity of 1.10 dl/g and the sheath portion having an apparent viscosity lower than that of the core portion, this composite fiber having a birefringence of at least $36.0\times10^{-3}$.

The process for producing the composite fiber according to the present invention comprises preparing a composite structure comprising a core portion of a vinylidene fluoride resin having an inherent viscosity of at least 1.10 dl/g and at least one layer of a sheath portion covering over said core portion and having an apparent viscosity lower than that of the vinylidene fluoride resin of the core, while at least one of the core portion and the sheath portion is in molten state, and then subjecting the composite to at least one step stretching to a stretching degree of 5.0-fold or more at a temperature which is lower but not lower by 30° C. or more than the melting point of the resin of the core.

DETAILED DESCRIPTION OF THE INVENTION

Composite fiber

The composite fibers of a vinylidene fluoride resin according to the present invention each have at least a two-layer structure of a sheath and a core, each comprising the resin.

Chemical entity

The constituent resin for either one of the layers comprises a vinylidene fluoride resin.

The term "vinylidene fluoride resin" as herein used is inclusive of vinylidene fluoride homopolymers, copolymers of at least 50 mole % of vinylidene fluoride units and units of one or more of comonomers copolymerizable therewith and compositions comprising at least one of these as the main component, preferably with a content of vinylidene fluoride uuits of at least 50 mole %. Particularly, for the vinylidene fluoride resin constituting the core, it is preferable to use a homopolymer, a copolymer of binary, ternary or more components with at least 70 mole % of vinylidene fluoride units or a composition comprising any of these as the main component with a content of vinylidene fluoride units of at least 70 mole %, more preferably a homopolymer, a copolymer with at least 90 mole % of vinylidene fluoride units or a composition comprising any of these as the main component with a content of vinylidene fluoride units of at least 90 mole %, further preferably a vinylidene fluoride homopolymer alone or a composition comprising at least 95% by weight of a vinylidene fluoride homopolymer.

Here, in the case of a vinylidene fluoride copolymer, the comonomers copolymerizable with vinylidene copolymer are not particularly limited. Among them, haloolefins such as vinyl fluoride, trifluoroethylene, tetrafluoroethylene, trifluorochloroethylene and the like, particularly fluorine-containing olefin are preferably used. As constituents in a composition, additives such as plasticizers, softeners, stabilizers, pigments, etc., resins compatible with polyvinylidene fluoride, for example, copolymers composed primarily of methyl acrylate may be used.

Structure of the fiber

The composite fiber of the present invention has a structure of at least two layers. For example, a structure comprising two layers of one sheath and one core, a multi-layer structure having one layer or multiple layers interposed between sheath and core, or a structure as an extreme case with continuously varying constitution between the surface layer and the core may be adopted as desired. However, in view of facility in working, the double layer structure consisting of a sheath and a core is preferable.

Such a structure of the invention comprising at least two layers is constituted of vinylidene fluoride resins with respectively different apparent viscosities, that of the resin for the sheath being lower than that of the resin for core. Particularly, when there are other layers between the two layers of sheath and core, it is desirable that the layer nearer to the surface layer have a lower apparent viscosity. The difference in apparent viscosity between the sheath and the core is desirably at a certain level or higher, specifically, 4,000 poise or higher, more preferably 6,000 poise or higher, as measured at 260° C., at a shearing rate of 100/sec. This is because it is difficult to obtain marked improvement of knot strength outside this range.

The apparent viscosity mentioned in the present invention is a value determined by means of a flow tester of the type Koka according to the Japanese Society of Polymer Chemistry, produced by Shimazu Seisakusho Co., through a nozzle of 1 mm in diameter and 10 mm in length. More specifically, a plunger is permitted to fall under a constant pressure to extrude a molten resin, and the apparent viscosity, $\eta_{app}$, is determined from the pressure applied, P (kg/cm$^2$); the amount extruded, Q (cc/min.); the diameter of the nozzle, D cm; the length of the nozzle, L (cm); and the acceleration of gravity, g (cm/sec$^2$), according to the following formula:

$$\eta_{app} = \frac{\pi D^4 P g}{128 L Q}$$

For making the apparent viscosity of the sheath portion lower than that of the core portion, a method as described below, for example, may be employed. One method comprises choosing a resin for the sheath portion which has an inherent viscosity lower than that of the resin for the core portion, the difference in inherent viscosity being at least 0.1 dl/g, preferably at least 0.15 dl/g, more preferably at least 0.20 dl/g. The inherent viscosity as herein mentioned refers to a viscosity value of a solution of a resin in dimethylformamide as the solvent under the conditions of a concentration of 0.4 g/dl and a temperature of 30° C.

The correlation with respect to viscosity can also be realized by incorporating a softening agent only in the sheath portion or in greater amount in the sheath portion. The softening agent as herein mentioned refers to materials which can promote the flow of a resin upon its melting, including plasticizers such as polyester plasticizers, softening materials used for softening of the resin after molding, such as resins having lower glass transition points than that of the vinylidene fluoride resin employed and being compatible with the vinylidene fluoride resin employed (e.g., polymethyl acrylate, copolymers comprising methyl acrylate as the main component with comonomers such as isobutylene or methyl methacrylate).

Even if the apparent viscosity of the sheath portion is lower than that of the core portion, and each layer constituted of a vinylidene fluoride resin, no great knot strength can be obtained if the inherent viscosity of the core portion is low. Thus, the inherent viscosity of the core portion is required to be at least 1.10 dl/g, preferably at least 1.20 dl/g. The inherent viscosity mentioned here is measured under the same conditions as described hereinabove.

Further, in the present invention, the index of double refraction of the fiber is required to be at least $36\times10^{-3}$. This is because the knot strength will become lower if the index is smaller than this value. Preferably, the birefringence is $37\times10^{-3}$ or higher, more preferably $38\times10^{-3}$ or higher, in order to increase the knot strength.

The birefringence mentioned here may be measured according to the conventional method generally called the Retardation method as described in "Kobunshi" (Macromolecule), Vol. 5, pp. 306–310.

More specifically, the end of a columnar fiber is cut in shape of a wedge, placed obliquely in the direction of 45° under crossed Nicols of a polarized microscope and observed by permitting Na-D line ($\lambda=589$ m$\mu$) to pass therethrough.

The difference in distance $n\lambda$ obtained from the number (n) of black stripes appearing on the wedge-shaped cut end is measured, and further its fraction of difference in distance $\epsilon\lambda$ is measured by means of a compensator. If the diameter of the fiber is expressed by d, the inherent birefringence of the fiber $n\parallel - n\perp = \Delta n$ can be determined from the following formula:

$$(n+\epsilon)\lambda = d\times\Delta n$$

It is desirable that the composite fiber according to the present invention have a surface refractive index of 1.415 or lower, preferably 1.410 or lower.

The composite fiber according to the present invention has a diameter generally from about 5 mm to 2 $\mu$m, preferably from 4 mm to 5 $\mu$m, more preferably from 3 mm to 10 $\mu$m, most preferably from 2.5 mm to 15 $\mu$m.

Analysis of the composite fiber

As shown in the Examples set forth hereinafter, the composite fiber of the present invention not only has excellent knot strength, but also excellent tensile strength and luster, and further processability and productivity.

Such effects may be attributed to a mechanism as described below, when considered in conjunction with various facts as described below.

The composite fiber of the present invention, as shown in the following Examples, in spite of its great birefringence, has a smaller refractive index at the surface layer as compared with the mono-layer filament. Refractive index and birefringence are correlated with the degree of orientation, refractive index and birefringence being greater with greater degree of orientation, and therefore the composite of the present invention, while it is highly oriented as a whole, is considered to have a smaller degree of orientation at the surface layer portion than a mono-layer filament.

As is well known, a mono-layer monofilament which has been spun has a skin-core structure, with only the skin being highly oriented and the core insufficiently oriented. When such a monofilament is stretched, cleavage of the main polymer chain of the polymer which forms the skin will occur to bring about lowering of knot strength. On the contrary, in the case of the present invention, it may be considered that the difference in the degree of orientation is small between the skin and the core, whereby the distribution of orientation is uniformized within the cross-section, with the result that the knot strength is high. Also, with respect to the mono-layer monofilament, various attempts have been made in order to uniformize the distribution of orientation in the skin-core structure, but in these attempts, when made with respect to the process, the physical properties are sharply influenced by the changes in process conditions, whereby a product of constant quality cannot be obtained, while when made with respect to formulation, the effects obtained proved to be insufficient. In contrast, the composite fiber of the present invention can be improved also in this respect.

The fiber of the present invention, since it has such excellent characteristics as described above, may be used as filament for fishery use such as fishing lines, fishing nets, etc. In addition, it can also be utilized usefully for a diversity of uses, including various ropes such as ropes for appliances for exploitation of the sea bottom or ropes for appliances for observation of sea bottom earthquakes; various nets such as nets for prevention of landslide or insect screening; string for rackets; fibers for surgical operations; etc.

Production of the fiber

Such a composite fiber of the present invention can be obtained by preparing a composite comprising a core portion of a vinylidene fluoride resin having an inherent viscosity of at least 1.10 dl/g and at least one layer of a sheath portion covering over the core portion and having an apparent viscosity lower than that of the vinylidene fluoride resin of the core, while at least one of the core portion and the sheath portion is in molten state, preferably according to the co-extrusion method, and then subjecting the composite to at least one-step stretching of a stretching degree of 5.0-fold or more at a temperature which is lower but not lower by 30° C. or more than the melting point of the resin of the core. When the stretching temperature is at or higher than the melting point of the resin of the core, the fiber will be broken through its melting, and when the stretching temperature is lower by 30° C. or more microvids will be generated within the body of the fiber, which microvids can cause the fiber to get white, whereby the knot strength of the fiber will be reduced. The stretching temperature is lower preferably by 3° to 25° C., more preferably by 5° to 20° C., than the melting point of the resin of the core. The melting point herein used is the peak temperature obtained on a differential scanning calorimeter (DSC) at a heating velocity of 8° C./min. In the case of two-step stretching, it is preferable to use the method as disclosed in Japanese Patent Publication No. 22574/1978, in which the first-step stretching is conducted to a stretching degree between the primary inflection point and the secondary inflection point on the birefringence Δn value curve or the Young's modulus curve measured for various stretching degrees, and subsequently the second stretching is conducted.

The method disclosed in Japanese Patent Publication No. 22574/1978 is based on the following discovery. In practicing stretching of an unstretched polyvinylidene fluoride fiber according to a conventional method, when the respective values of Young's modulus and birefringence Δn as measured by sodium-D line under crossed Nicols for respective stretching degrees are plotted versus the respective stretching degrees (with stretching degree as abscissa), a curve ascending toward the right from the original point is obtained, which curve is lowered in its rate of ascent at a certain stretching degree (primary inflection point) and increased in its rate of ascent at a greater stretching degree than the aforesaid stretching degree (secondary inflection point), whereby a so-called S-curve is obtained. These primary and secondary inflection points correspond to substantially the same stretching degrees in both of the curves of Young's modulus curve and of the birefringence. Under such a circumstance, when the first stretching is conducted to a stretching degree between the stretching degrees giving the primary inflection and the secondary inflection on the curves, and then the second stretching is conducted, a polyvinylidene fiber having a high knot strength can be obtained.

As to the co-extrusion method and structure of a die for co-extrusion, which are used in preferable embodiment of the present process, any of those conventionally used in the art may be used. Their examples are well described in textbooks in the field of this art. One of preferable examples is disclosed in "A Study of Coextrusion in a Circular Die" in Journal of Applied Polymer Science, Vol. 19, pp 1875–1883 (1975) by Chang Dae Han. Also, stretching of the exturdate formed by co-extrusion may be performed according to any desirable technique conventionally employed or adoptable for stretching of an orientatable thermoplastic fiber. Examples of such a technique are described in textbooks concerning stretching of synthetic fibers.

The following Examples are set forth merely for illustrative purpose and they are not intended to be limitative of the present invention.

EXAMPLE 1

As the sheath material resin, a vinylidene fluoride homopolymer having a $\eta_{inh}$ of 1.00 dl/g was extruded by a 25 mm diam. extruder at 265° C. The sheath material had an apparent viscosity of 11,000 poise at 260° C. and a shearing rate of 100/sec.

As the core material resin, a vinylidene fluoride homopolymer (melting point: 178° C. as a peak temperature on DSC (differential scanning calorimeter) at a temperature elevating rate of 8° C./mm) was extruded by a 35 mm diam. extruder at 275° C. The core material had an apparent viscosity of 39,000 poise at 260° C. and a shearing rate of 100/sec. These materials were co-extruded through a 1.5 mm concentric sheath-core composite nozzle so that the core resin was covered with the sheath resin; permitted to pass through an air atmosphere heated at 250° C. in a mantle covering equipped with a heater under the nozzle; and then cooled as they were in water at 30° C. This step was followed continuously by stretching to 5.4 fold in a glycerine bath at 165° C. and further by stretching to 1.22-fold in a glycerine bath at 170° C. Finally, the fiber was subjected to 5% relaxation treatment in a hot air atmosphere of 80° C. and wound up. The resultant fiber was transparent with luster, having a diameter of 128 μm, the volume of the sheath portion comprising 20%, with a tensile strength of 93 kg/mm$^2$ with an elongation at rupture of 21%, a knot strength of 85 kg/mm$^2$ with an elongation at rupture of 15%. The refractive index on the fiber surface was 1.4069, and the birefringence of the fiber $39.5\times10^{-3}$.

The refractive index was measured according to the method described in "Kobunshi" (Macromolecule), Vol. 5, pp. 306–310, and the refractive index on the surface in the fiber direction of a sample fiber was measured by means of an Abbe refractometer according to the Becke method at 25° C., in an atmosphere of a humidity of 50%.

COMPARATIVE EXAMPLE 1

A composition of 100 parts by weight of a vinylidene fluoride homopolymer having a $\eta_{inh}$ of 1.3 dl/g and 5 parts by weight of a polyester plasticizer having an average molecular weight of 2,200 prepared from propylene glycol and adipic acid was extruded at 275° C. by a 35 mm diam. extruder through an orifice. The resultant fiber had an apparent viscosity of 20,000 poise at 260° C. and a shearing rate of 100/sec.

Melt spinning, stretching and heat treatment were conducted according to the procedure in Example 1, except that a mono-layer was formed in place of the sheath-core double layer. The degree of stretching was 5.4-fold in the first-step stretching and 1.18-fold in the second-step stretching, whereby a maximum knot strength value of 68.5 kg/mm$^2$ was exhibited. Its elongation at rupture was 16.5%, and the tensile strength was 81 kg/mm$^2$ with an elongation at rupture of 24.2%. The refractive index on the fiber surface was 1.4272 and the birefringence of the fiber 35.5 x$10^{-3}$.

EXAMPLE 2

As the sheath material, a composition of 100 parts of a vinylidene fluoride resin having a $\eta_{inh}$ of 1.1 dl/g and 3 parts by weight of the same plasticizer as used in Comparative Example 1 (the composition having an apparent viscosity of 10,000 poise measured at 260° C. and a shearing rate of 100/sec.) was extruded at 260° C. On the other hand, as the core material, a composition of a vinylidene fluoride homopolymer having a $\eta_{inh}$ of 1.4 dl/g and 5 parts by weight of the same plasticizer as used in Comparative Example 1 (the composition having an apparent viscosity of 28,000 poise measured at 260° C. and a shearing rate of 100/sec., and a melting point of 178° C.) was extruded at 275° C. Following otherwise the same conditions as in Example 1, a transparent fiber was obtained, which had a fiber diameter of 210 μm and a volume ratio of 15% occupied by the sheath portion. Its tensile strength was 87 kg/mm$^2$ with an elongation at rupture of 24.0%, and the knot strength was 75 kg/mm$^2$ with an elongation at rupture of 18.5%. The birefringence of the fiber was found to be $39.0\times10^{-3}$, the refractive index on the fiber surface being 1.4132.

EXAMPLE 3

As the sheath material, a copolymer of 98 mole % of vinylidene fluoride and 5 mole % of trifluorochloroethylene having a $\eta_{inh}$ of 1.00 dl/g (an apparent viscosity of 10,000 poise measured at 260° C. and a shearing rate of 100/sec) and extruded at 260° C. As the core material, a composition of a vinylidene fluoride homopolymer having a $\eta_{inh}$ of 1.3 dl/g and 5 parts by weight of the same plasticizer as used in Comparative Example 1 (the composition having an apparent viscosity of 15,000 poise measured at 260° C. and a shearing rate of 100/sec., and a melting point of 178° C.) was extruded at 275° C. Following otherwise the same procedure as in Example 1, a fiber was obtained, which had a fiber diameter of 210 μm and a volume of 10% occupied by the sheath portion, its tensile strength being 81 kg/mm$^2$ with an elongation at rupture of 23.3%. The knot strength was 70.5 kg/mm$^2$ with an elongation at rupture of 16.5%, and the birefringence was $39.3\times10^{-3}$.

EXAMPLE 4

As the sheath material, a vinylidene fluoride homopolymer having a $\eta_{inh}$ of 0.92 dl/g (an apparent viscosity of 9,500 poise measured at 260° C. and a shearing rate of 100/sec) was extruded at 260° C. As the core material, a composition of a vinylidene fluoride homopolymer having a $\eta_{inh}$ of 1.30 dl/g and 4 parts by weight of the same plasticizer as used in Comparative Example 1 (the composition having an apparent viscosity of 21,000 poise measured at 260° C. and a shearing rate of 100/sec., and a melting point of 178° C.) was extruded at 275° C. After melt spinning was carried out in the same manner as in Example 1, the spun fiber was stretched 5.45-fold in a glycerine bath at 164° C. and then 1.25-fold in a glycerine bath at 168° C. Then a 5% relaxation treatment was applied to the stretched fiber in a hot air atmosphere of 60° C. The fiber obtained had a diameter of 210 μm and a volume of 8% occupied by the sheath portion, its tensile strength being 77 kg/mm$^2$ with an elongation at rupture of 25.3%. Its knot strength was 68 kg/mm$^2$ with an elongation at rupture of 18.6%, the birefringence being $39.5\times10^{-3}$ and the refractive index on the surface 1.4078.

EXAMPLE 5

As the sheath material, a vinylidene fluoride homopolymer having a $\eta_{inh}$ of 0.85 dl/g (an apparent viscosity of 9,500 poise measured at 260° C. and a shearing rate of 100/sec) was extruded at 260° C. As the core material, a composition of a vinylidene fluoride homopolymer having a $\eta_{inh}$ of 1.30 dl/g and 7.5 parts by weight of a polymethyl acrylate homopolymer (the composition having an apparent viscosity of 18,000 poise measured at 260° C. and a shearing rate of 100/sec., and a melting point of 178° C.) was extruded at 270° C. After melt spinning was carried out in the same manner as in Example 1, the spun fiber was stretched 5.4-fold in a glycerine bath at 165° C. and then 1.22-fold in a glycerine bath at 169° C. Then a 5% relaxation treatment was applied to the stretched fiber in a hot air atmosphere of 55° C. The fiber obtained had a diameter of 105 μm and a volume ratio of 22% occupied by the sheath portion, its tensile strength being 93 kg/mm$^2$ with an elongation at rupture of 23.8%. Its knot strength was 86 kg/mm$^2$ with an elongation at rupture of 16.7%, the birefringence being $40.5\times10^{-3}$ and the refractive index on the surface 1.4088.

EXAMPLE 6

As the sheath material, a vinylidene fluoride homopolymer having a $\eta_{inh}$ of 0.97 dl/g (an apparent viscosity of 11,000 poise measured at 260° C. and a shearing rate of 100/sec) was extruded at 260° C. As the core material, a composition of a vinylidene fluoride homopolymer having a $\eta_{inh}$ of 1.3 dl/g and 3 parts by weight of a copolymerized polyester of 1,3-butane diol, propylene glycol and adipic acid ("PN-350" produced by Adeka-Argus Co., Japan)(the composition having an apparent viscosity of 20,000 poise measured at 260° C. and a shearing rate of 100/sec., and a melting point of 178° C.) was extruded at 275° C. Under otherwise the same conditions as in Example 3, a transparent fiber with more luster was obtained, which had a fiber diameter of 280 μm and a volume of 10% occupied by the sheath portion, its tensile strength being 103 kg/mm$^2$ with an elongation at rupture of 2.8%. Its knot strength was 91 kg/mm$^2$ with an elongation at rupture of 15.1%, the birefringence being $39.3\times10^{-3}$ and the surface refractive index 1.4121.

COMPARATIVE EXAMPLE 2

A vinylidene fluoride homopolymer having a $\eta_{inh}$ of 1.01 dl/g (an apparent viscosity of 13,000 poise measured at 260° C., a shearing rate of 100/sec) was extruded at 265° C. to be spun into air through a nozzle with an orifice diameter of 2.0 mm and cooled in water at 35° C. Then, the fiber was stretched 5.4-fold in a glycerine bath at 163° C. and further 1.18-fold in a glycerine bath. The stretched fiber was subjected to a 5% relaxation treatment in a hot atmosphere of 60° C. The fiber obtained had a diameter of 128 μm, a tensile strength of 78 kg/mm$^2$ with an elongation at rupture of 24.5%, a knot strength of 58.5 kg/mm$^2$ with an elongation at rupture of 19.3%, a birefringence of $36.1\times10^{-3}$, and a surface refractive index of 1.4238.

What is claimed is:

1. A composite fiber comprising at least a two layer structure of a sheath and a core, each layer comprising a vinylidene fluoride resin, the core portion having an inherent viscosity of at least 1.10 dl/g and the sheath portion having an apparent viscosity lower than that of the core portion, said composite fiber having an birefringence of at least $36.0\times10^{-3}$.

2. A composite fiber according to claim 1, wherein the difference in apparent viscosity between the sheath portion and the core portion is at least 4,000 poise measured at 260° C. and a shearing rate of 100/sec.

3. A composite fiber according to claim 1, wherein the difference in apparent viscosity between the sheath portion and the core portion is at least 6,000 poise measured at 260° C. and a shearing rate of 100/sec.

4. A composite fiber according to claim 1, wherein the vinylidene fluoride resin is a member selected from the group consisting of vinylidene fluoride homopolymers, copolymers each containing at least 70 mole % of vinylidene fluoride units, and compositions each containing any of these as the main component with a content of vinylidene fluoride units of at least 70 mole %.

5. A composite fiber according to claim 4, wherein the vinylidene fluoride resin is a member selected from the group consisting of vinylidene fluoride homopolymers, copolymers each containing at least 90 mole % of vinylidene fluoride units, and compositions each containing any of these as the main component with a content of vinylidene fluoride units of at least 90 mole %.

6. A composite fiber according to claim 4, wherein the vinylidene fluoride resin is a member selected from the group consisting of vinylidene fluoride homopolymers, and compositions each containing at least 95 mole % of a vinylidene fluoride homopolymer.

7. A composite fiber according to claim 1, wherein the apparent viscosity of the sheath portion is lower than that of the core portion due to an inherent viscosity of the resin of the sheath portion lower than that of the resin of the core portion.

8. A composite fiber according to claim 1, wherein the apparent viscosity of the sheath portion is lower than that of the core portion due to the presence of a softening agent incorporated only or in greater amount in the sheath portion.

9. A composite fiber according to claim 8, wherein the softening agent is a plasticizer.

10. A composite fiber according to claim 8, wherein the softening agent is a softening material.

11. A composite fiber according to claim 8, wherein the softening agent is a resin which is compatible with the vinylidene fluoride resin employed and has a lower glass transition temperature than said vinylidene fluoride resin.

12. A composite fiber according to claim 1, wherein the core portion has an inherent viscosity of at least 1.20 dl/g.

13. A composite fiber according to claim 1, having a birefringence of at least $37\times10^{-3}$.

14. A composite fiber according to claim 13, having a birefringence of at least $38\times10^{-3}$.

15. A composite fiber according to claim 1, having a refractive index on the surface thereof of 1.415 as a maximum.

16. A composite fiber according to claim 15, having a refractive index on the surface thereof of 1.410 as a maximum.

* * * * *